US011518601B2

(12) United States Patent
Bublewitz et al.

(10) Patent No.: US 11,518,601 B2
(45) Date of Patent: Dec. 6, 2022

(54) APPLICATION SYSTEM WITH IMPROVED SEAL

(71) Applicant: 3LMED GMBH, Marburg/Lahn (DE)

(72) Inventors: Alexander Bublewitz, Herborn (DE); Jens-Peter Reber, Meinerzhagen (DE)

( * ) Notice: Subject to any disclaimer, the term of this patent is extended or adjusted under 35 U.S.C. 154(b) by 0 days.

(21) Appl. No.: 17/258,079

(22) PCT Filed: Jan. 7, 2020

(86) PCT No.: PCT/EP2020/050225
§ 371 (c)(1),
(2) Date: Jan. 5, 2021

(87) PCT Pub. No.: WO2020/151938
PCT Pub. Date: Jul. 30, 2020

(65) Prior Publication Data

US 2021/0229891 A1 Jul. 29, 2021

(30) Foreign Application Priority Data

Jan. 23, 2019 (DE) ..... 102019101651.7

(51) Int. Cl.
*B65D 81/32* (2006.01)
*B05C 17/005* (2006.01)

(52) U.S. Cl.
CPC ..... *B65D 81/325* (2013.01); *B05C 17/00553* (2013.01)

(58) Field of Classification Search
CPC ..... B65D 81/325; B05C 17/00553
See application file for complete search history.

(56) References Cited

U.S. PATENT DOCUMENTS 6,769,564 B2 * 8/2004 Prestele ..... B65D 81/3283 215/276
7,631,782 B2 * 12/2009 Engelbrecht ..... B05C 17/00553 222/137
8,007,164 B2 * 8/2011 Miyano ..... B05C 17/00553 366/173.1

(Continued)

FOREIGN PATENT DOCUMENTS

DE 20106406 U1 8/2002
EP 0730913 A1 9/1996

(Continued)

OTHER PUBLICATIONS

International Search Report and Written Opinion for Int. App. No. PCT/EP2020/050225, dated Mar. 4, 2020.

*Primary Examiner* — Frederick C Nicolas
(74) *Attorney, Agent, or Firm* — McDonnell Boehnen Hulbert & Berghoff LLP

(57) ABSTRACT

An application system is presented having a cartridge, at least one first accessory part, for example a stopper, and at least one second accessory part, for example a static or dynamic mixer. The cartridge has at least one container with an outlet opening and at least one outlet connected to the container via the outlet opening on the end face of the cartridge, wherein the at least one outlet can be connected to the at least one first accessory part and the at least one second accessory part such that a seal is produced between the outlet and the respective accessory part. At least one separate seal plane is provided for each accessory part.

14 Claims, 5 Drawing Sheets

(56) References Cited

U.S. PATENT DOCUMENTS

| | | | | |
|---|---|---|---|---|
| 8,100,295 | B2 * | 1/2012 | Keller | B05C 17/00553 222/137 |
| 8,365,958 | B2 * | 2/2013 | Ho | B05C 17/00553 222/137 |
| 9,149,775 | B2 * | 10/2015 | Hiemer | B05C 17/00553 |
| 10,099,838 | B2 * | 10/2018 | Dean | B65D 39/0052 |
| 10,286,370 | B2 * | 5/2019 | Vogt | B01F 35/3202 |
| 10,413,384 | B2 * | 9/2019 | Bublewitz | A61M 35/003 |
| 10,463,413 | B2 * | 11/2019 | Vogt | A61B 17/8833 |
| 2011/0198370 | A1 * | 8/2011 | Ho | B05C 17/00513 222/137 |

FOREIGN PATENT DOCUMENTS

| | | | |
|---|---|---|---|
| EP | 1440737 | A1 | 7/2004 |
| EP | 2632606 | B1 | 7/2018 |
| WO | 2008/113196 | A1 | 9/2008 |
| WO | 2013/056872 | A1 | 4/2013 |

* cited by examiner

APPLICATION SYSTEM WITH IMPROVED SEAL

CROSS REFERENCE TO RELATED APPLICATIONS

The present application is a U.S. National Phase Application pursuant to 35 U.S.C. § 371 of International Application No. PCT/EP2020/050225 filed Jan. 7, 2020, which claims priority to German Patent Application No. 102019101651.7 filed Jan. 23, 2019. The entire disclosure contents of these applications are herewith incorporated by reference into the present application.

BACKGROUND

The present disclosure relates to an application system having a cartridge, at least one first accessory part and at least one second accessory part, wherein the cartridge has at least one container with an outlet opening and at least one outlet connected to the container via the outlet opening on the end face of the cartridge, wherein the at least one outlet can be connected to the at least one first accessory part and to the at least one second accessory part such that a seal is produced between the outlet and the respective accessory part. An accessory part can be a stopper or a mixer, for example.

Application systems are typically used for storing and applying flowable materials and have to meet various requirements.

On the one hand, the materials stored in the application systems are to be protected from environmental influences and thus stored unmodified as long as possible. To this end, it is necessary to design the application systems and their cartridges or containers in which the materials can be stored, respectively, in such a manner that they can be sealed tightly. This is achieved by respectively designed closing elements, such as stoppers. In this way, even reactive and/or air sensitive materials can be safely stored over a longer period of time.

On the other hand, the stored materials should be dischargeable from the application systems as easily and user-friendly as possible. Application systems are therefore typically closed on the side opposite the closable outlet using a piston, for which purpose the piston disclosed in EP 2 632 606 A1 is suitable, for example. Furthermore, the closable outlet is often connected to another accessory part for discharging the materials, and the materials are discharged by the second accessory part, for example, a discharge cannula or a mixer.

For the frequent case that the stored materials are to be stored in different containers of a cartridge and mixed during discharge, a static or dynamic mixer is typically used with the application system and placed onto the cartridge to mix the materials during discharge and prepare them for the intended use.

Such application systems are known, for example, from EP 0 730 913 A1. In this case, a double cartridge can be connected to a mixer or a stopper as accessory parts. Each of the containers of the double cartridge has an outlet which leads into a respective inlet of the mixer or can be sealed by respective closing projections of the stopper.

For tight sealing of the double cartridge, the respective closing projections of the stopper engage in the outlets and seal the end located in the discharge direction of the materials. Sealing is achieved in that the outer contour of the closing projections substantially corresponds to the inner contour of the outlets or slightly exceeds the outlets, wherein the latter are slightly widened by inserting the closing projections into the outlets.

Likewise, sealing is achieved between the mixer and the outlets of the double cartridge in that the inlet area of the mixer has respective inlets which engage in the outlets at the end in the material discharge direction and so provide a seal between the respective outlets and the mixer. This means that sealing between the cartridge and the accessory parts occurs at the ends of the outlets located in the material discharge direction.

EP 1 440 737 A1 also discloses an application system having a double cartridge, a stopper, and a mixer. The respective accessory parts are connected to the double cartridge by a threaded connection. For sealing between the respective accessory part and the outlets of the double cartridge, the inlets of the mixer or stopper are inserted into the outlets, wherein their outer diameter corresponds to the inner diameter of the outlets or exceeds it. Again, sealing occurs at the end of the outlets located in the material discharge direction, which ends are additionally widened here.

A similar teaching can be derived from WO 2008/113 196 A1, wherein likewise sealing at the end of the outlets of the double cartridge located in the material discharge direction is achieved in that the inlets of the mixer or stopper, respectively, are inserted into the outlets and have an outer contour corresponding to the inner contour of the outlets or exceeding it.

The solutions known from the prior art have the disadvantage, however, that the seal between the outlets of the cartridge and the accessory parts deteriorates during the storage of the materials, particularly for increased storage times of several weeks or months.

SUMMARY

It is therefore the problem of the present disclosure to provide an application system which allows a reliable and sufficient seal between the outlets of the cartridge and the accessory parts even for longer storage times.

This problem is solved by the features of claim 1.

According to the disclosure, an application system is provided having a cartridge, at least one first accessory part, particularly a stopper, and at least one second accessory part, particularly an applicator, a dynamic or static mixer, or a discharge cannula.

The cartridge includes at least one container, particularly two containers, wherein the at least one container has an outlet opening. At least one outlet connected to the container via the outlet opening is provided on the end face of the cartridge, which outlet can be connected to the first accessory part and the second accessory part such that a seal is produced between the at least one outlet and the respective accessory part. In other words, the cartridge having the respective outlets can be sealingly connected to a first and a second accessory parts. It is critical for the disclosure that at least one seal plane is provided for each accessory part and that each accessory part is associated with at least one of the seal planes. In other words, there is not one seal plane for all accessory parts; instead, different seal planes are associated with the first and the second accessory parts.

It is therefore the basic concept of the disclosure that a spatially separate sealing via at least one respective separate seal plane is provided for each accessory part between the at least one outlet and the accessory part. It was found that plastic deformation occurs on the at least one outlet of the cartridge and/or the inlet or closing area of the respective accessory part, particularly during longer storage times, which deformation is accompanied by a change in the inner or outer diameter of the inner or outer contour of the respective connected components.

After removing the first and/or second accessory part, said deformation typically results in seal deterioration of the respective other accessory part, that is, the second and/or first accessory part. A change of the contour of the at least one outlet of the cartridge was observed particularly in the case in which the cartridge is closed with a stopper for a longer period of storage time, such that an accessory part to be placed onto there subsequently, particularly a mixer, cannot be fully sealingly connected to the outlets of the cartridge. But this results in unintended contamination of the cartridge by the material to be discharged, particularly at a high discharge pressure. Such contamination typically requires a great cleaning effort of the cartridge after its use, particularly for cartridges intended for multiple use. If the contamination is severe, for example, if the stored materials have reacted with the ambient air or with each other, it is often inevitable to dispose of a contaminated cartridge although there are still materials stored in the containers which were meant to be discharged during another use of the application system.

Since multiple seal planes are provided according to the present disclosure, each of which being associated with another accessory part, the seal between the outlet and a first accessory part can be separated from the seal between the outlet and a second accessory part. Therefore the problems described above do no longer occur with the present disclosure.

A seal plane, in the meaning of the present disclosure, is that region where a seal is produced between the outlet of the cartridge and the respective accessory part. This seal can be provided by a respective contact surface or it can be achieved in that a portion of the accessory part, e.g., an inlet or stopper, is inserted into the outlet, particularly in a sealing and connecting manner, or vice versa.

The inner and outer contours of the components in engagement with each other can be adjusted such that a seal is produced, which is typically achieved in that the inner diameter of the outlet corresponds in the respective seal plane to the outer diameter of the accessory part component inserted therein. Depending on the material of the cartridge and the accessory parts, a specific excess of the section to be inserted can be provided, which can be achieved in that the outer diameter of the component to be inserted is greater than the inner diameter of the outlet. The seal is typically produced by means of a contact seal. It is in principle conceivable to design the respective seal plane with a seal, particularly an elastic seal, for example by providing an elastic sealing element in the respective seal plane.

It is preferred to provide the seal between the first accessory part and the at least one outlet via at least one first seal plane and to provide the seal between the second accessory part and the at least one outlet via at least one second seal plane. This ensures a unique association of each one accessory part and at least one seal plane.

The seal between the accessory parts and the outlet of the cartridge is critical for the present disclosure. It is therefore conceivable that the respective, particularly the first and/or second, seal plane is also configured in the cartridge, which can be useful, in particular, if the at least one outlet projects into the cartridge. In that case, the outlet opening of the at least one container would be disposed facing the end face in a direction opposite to the material discharge direction.

In other words, it must only be ensured that the respective, particularly the first and/or second, seal plane is disposed downstream of the outlet opening when viewed in the material discharge direction. Therefore the respective, particularly first and/or second, seal plane can start immediately at the cartridge outlet duct, however it may be designed, which is disposed downstream of the outlet opening of the container in the material discharge direction.

According to a preferred embodiment of the present disclosure, at least one first seal plane is disposed at a spacing from the end face of the cartridge in the material discharge direction or, put differently, in the discharge direction of the materials stored in the cartridge. The first seal plane is therefore not situated in a radial plane with the end face of the cartridge. This has the advantage that the seal plane is more flexible in this case, which improves the seal. In continuation of this thought, at least one second seal plane is provided, which is disposed at a spacing from the cartridge in the discharge direction of the materials stored in the cartridge.

It is further preferred that at least one first seal plane is disposed at a spacing from the end face of the cartridge upstream of at least one second seal plane in the material discharge direction. In other words, the second seal plane is disposed behind the first seal plane in the discharge direction, such that, if the outlet is projecting away from the end face of the cartridge in the material discharge direction, the first seal plane is closer to the end face than the second seal plane. This is particularly advantageous if the first accessory part is first connected to the cartridge and then, after removing the first accessory part, the second accessory part is connected to the cartridge.

If the first seal plane is disposed upstream of the second seal plane when viewed from the end face of the cartridge, the second seal plane can be protected against contamination by the materials in the at least one container when the outlet is connected to the first accessory part. For this reason, this embodiment is particularly preferred if the first accessory part is a stopper and the second accessory part is an applicator, a dynamic or static mixer, or a discharge cannula.

In another preferred embodiment, an annular gap remains between the first and/or second accessory part and the respective, particularly second and/or first, seal plane if the first and/or second accessory part is connected to the at least one outlet of the cartridge. In other words, the inner and/or outer contours of the at least one outlet and the first and/or second accessory part are adapted to each other in such a manner that a seal between the first and/or second accessory part and the at least one outlet is produced via the respective, particularly the first and/or second, seal plane, but a free annular space remains between the respective, second and/or first, seal plane and the first and/or second accessory part if the first and/or second accessory part is connected to the outlet. Particularly, the annular gap has a circumferential diameter of 0.5 mm to 5 mm, preferably 1 mm to 3 mm, particularly preferably 2 mm±0.5 mm. The second seal plane can be free form and contact-free with respect to the first accessory part.

This ensures that, even in the event of manufacturing-related variations of the inner or outer contours of the outlet of the cartridge and the first and/or second accessory part, there is no contact surface and thus no seal between the first and/or second accessory part and the respective, particularly second and/or first, seal plane, which could otherwise result in a deformation of the respective, particularly second and/or first, seal plane and could thus deteriorate the seal between the second and/or first accessory part and the at least one outlet.

According to another preferred embodiment, a seal-free section is provided between the respective, particularly the first and the second, seal planes. This prevents the seal areas from adversely influencing, or even interfering with, each other, which could happen if the transition of the respective, particularly the first and second seal planes, were seamless. The seal-free section preferably has an axial length of 70% to 130%, preferably of 100%±20%, of the axial length of the respective, particularly the first or the second, seal plane.

According to another preferred embodiment, the at least one first seal plane is formed in the region of 5% to 50%, preferably of 10% to 40%, of the axial length of the outlet when viewed in the material discharge direction from the end face of the cartridge. The first seal plane can also just extend over a partial region, it is therefore not a must that the seal plane is formed over the entire region mentioned. Preferably, the axial length of the first seal plane is 5% to 30%, preferably 10% to 25%, of the axial length of the outlet.

Alternatively, or in addition, the at least one second seal plane is formed in the region of 51% to 100%, preferably of 55% to 100%, of the axial length of the outlet when viewed in the material discharge direction from the end face of the cartridge. The second seal plane can also just extend over a partial region, it is therefore not a must that the seal plane is formed over the entire region mentioned. Axial length of the outlet means its axial extension from the end face of the cartridge in the material discharge direction. Preferably, the axial length of the second seal plane is 5% to 30%, preferably 10% to 25%, of the axial length of the outlet.

If the outlet extends over 11.5 mm in the distal direction from the end face of the cartridge, for example, the first seal plane according to this preferred embodiment is formed in the region of 2 mm to 4.5 mm and/or the second seal plane is formed in the region of 6.25 mm to 11.5 mm, wherein the seal planes may extend just over a partial region. It is also possible, however, that the first and/or second seal planes extend over the entire region mentioned above.

In other words, the second seal plane is preferably disposed above the first third of the axial length of the outlet and can extend to the end of the outlet in the material discharge direction. This allows a particularly good seal between the first and the second accessory parts and the outlet of the cartridge even after long storage periods.

Particularly in the case in which the first accessory part is a stopper and the second accessory part is an applicator, a mixer, or a discharge cannula, this embodiment is preferred because the outlet of the cartridge is less flexible in the first third viewed from the end face of the cartridge in the material discharge direction than in the region situated above it in the material discharge direction. This is because the first third of the outlet is closer to the relatively rigid end face of the cartridge, such that flexibility is reduced compared to a region situated farther away from the end face. A further advantage is that the first seal plane in this region of the outlet, i.e., in the first third, will not result in deformation of the outlet even over a long storage period. Therefore this embodiment achieves a particularly good seal even for increased storage periods.

According to a preferred embodiment of the present disclosure, the first and/or the second accessory part can be inserted into, or sealingly connected to, the outlet. Accordingly, the outer contours of the first and/or second accessory part and the inner contour of the outlet in the region of the respective, particularly first and/or second, seal plane are configured such that a respective seal is produced when inserting the first and/or second accessory part into the outlet. The regions of the first and/or second accessory part that can be inserted into the outlet can be configured integrally with the respective accessory part or represent a separate inlet region or an insert associated with the accessory part.

In a variant of this preferred embodiment, the one accessory part can be inserted in the outlet, while the other accessory part is configured such that the outlet can be inserted into it. In this variant, the seal planes would be formed on the inner and outer sides of the outlet. As another alternative, both accessory parts can be configured such that they can be placed over the outlet(s) of the cartridge, i.e., the outlets are inserted into the accessory parts, such that the seal planes are provided on the outer sides of the cartridge outlets.

In continuation of this thought, at least one first seal plane is formed on a first inner contour of the outlet and at least one second seal plane is formed on a second inner contour of the outlet. In other words, the outlet has a first inner contour and thus a first inner diameter in the region of the first seal plane and a second inner contour as well as a second inner diameter in the region of the second seal plane.

It is particularly preferred in this context that the first and/or second accessory part comprises an inlet that can be inserted into the outlet of the cartridge and the inner contour of the inlet is flush with the outlet opening of the container. In other words, the inner diameter of the outlet opening of the container, which opening leads into the outlet, corresponds to the inner diameter of the inlet of the first and/or second accessory part, particularly an applicator, a static or dynamic mixer, or a discharge cannula. This has the advantage that the discharge pressure when discharging the materials stored in the cartridge is not increased by the seal planes, but that the materials flowing from the outlet opening of the containers can flow directly into the inlet of the first and/or second accessory part without a change in direction or a deflection.

In another preferred embodiment, the first accessory part is a stopper and the second accessory part is an applicator, a dynamic or static mixer, or a discharge cannula.

The application system, particularly the cartridge, its outlet, the first and the second accessory parts, can be made of thermoplastics, particularly polypropylene, polyoxymethylene, polyethylene, polybutadiene, glass fiber or filler-reinforced thermoplastics, polyethylene terephtalate, cycloolefin copolymers, polycarbonate, polystyrene, or common copolymers, particularly polypropylene ABS plastics or the like. It is particularly preferred that polypropylene or polybutylene terephthalate is used for the cartridge. If the cartridge is made of polypropylene, the accessory part, such as a mixer or closure, is made of polyethylene or polyoxymethylene. For a harder cartridge made of polybutyl terephthalate, the accessory part, such as a mixer or stopper, would be made of polyethylene or polypropylene. If the cartridge and accessory part are combined, it is advantageous to use a hard polypropylene with a soft polypropylene, for example. Also, a glass fiber reinforced polypropylene can be combined with a non-glass fiber reinforced polypropylene. It is relevant for the sealing effect that at least the areas entering into sealing contact are made of well-sealing materials, e.g., hard/soft or soft/hard plastic combinations. For example, the inlet region of the mixer that can be connected to the outlets of the cartridge can be made of polyoxymethylene, whereas other regions of the mixer, e.g., the mixing element or the housing, can consist of a soft material, such as polypropylene.

The present disclosure is explained in greater detail with reference to exemplary embodiments and the drawings below. All characteristics described and/or depicted graphically are in themselves or in any combination the subject matter of the present disclosure, regardless of their summary or references in the claims.

DETAILED DESCRIPTION

Figure 1:
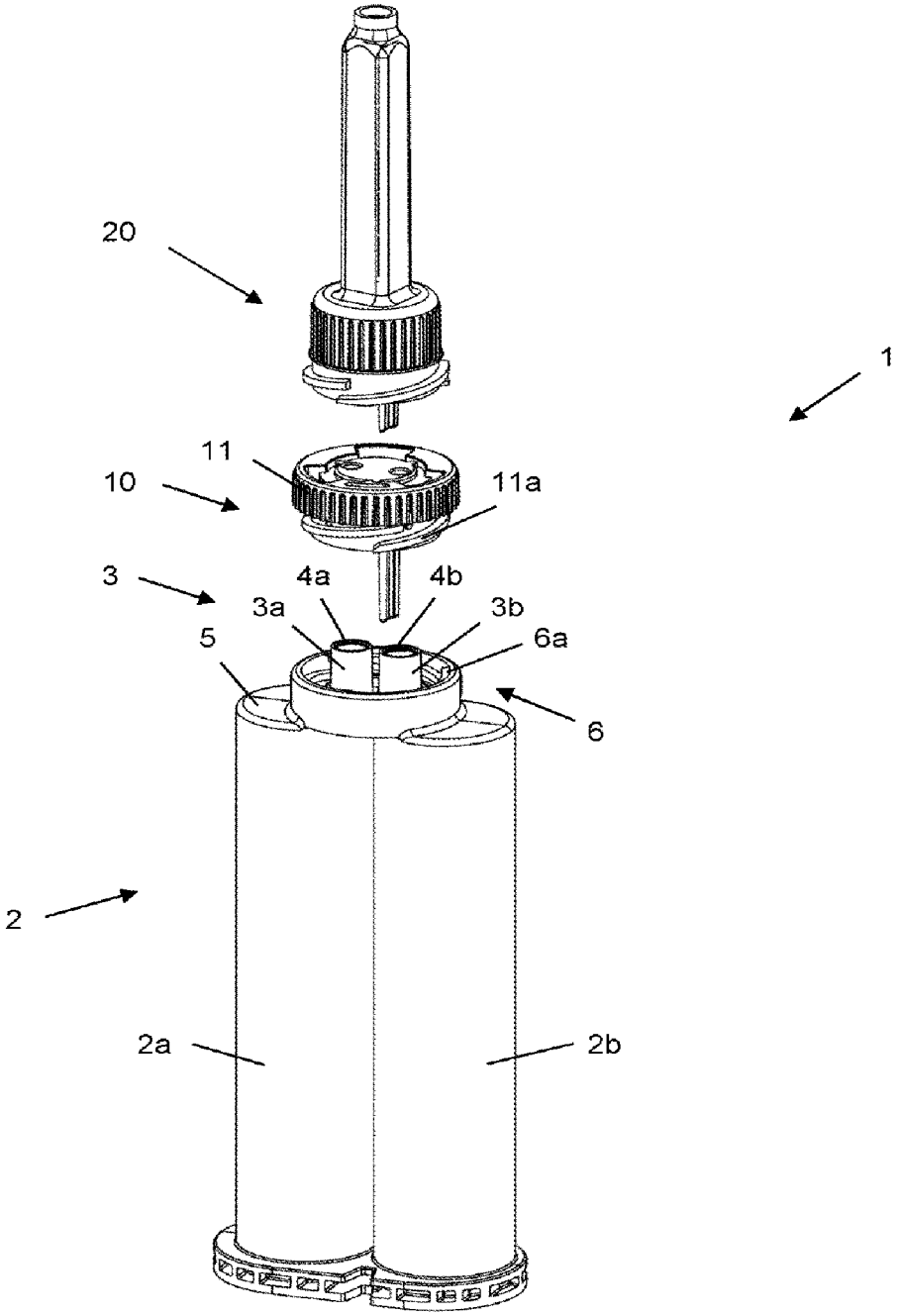
FIG. 1 shows an application system according to the present disclosure having a cartridge, a first accessory part configured as a stopper, and a second accessory part configured as a mixer.

The application system 1 according to FIG. 1 includes a cartridge 2 with a first container 2*a* and a second container 2*b*. The two containers 2*a*, 2*b* can be filled with material to be stored and are typically closed by a stopper and/or discharge piston (not shown) on their side opposite the outlet region 3 of the cartridge 2. The outlet region 3 includes the outlets 3*a* and 3*b* associated with the containers 2*a* and 2*b*, which are in fluid connection with the containers 2*a* and 2*b* via the outlet opening 4*a* or 4*b*, respectively. The axial length L of the outlets 3*a* and 3*b*, measured from the end face 5 of the cartridge, is for example 11.3 mm±1 mm. The axial length from the ends of the outlets 3*a* and 3*b* situated in the material discharge direction to the outlet openings 4*a* and 4*b* of the containers 2*a* and 2*b* is, for example, 11.5 mm±1 mm.

Worded differently, the outlet openings 4*a*, 4*b* lead into the outlets 3*a* and 3*b* of the cartridge 2. The outlets 3*a* and 3*b* extend in the material discharge direction from the end face 5 of the cartridge 2. The ends of the outlets 3*a* and 3*b* situated in the material discharge direction can have an increased inner diameter compared to the inner diameter of the outlet openings 4*a* and 4*b*, for example, increased by 10% compared to the inner diameter of the outlet openings 4*a* and 4*b*. Particularly, the outlet openings 4*a* and 4*b* can each have an inner diameter of 4 mm±0.1 mm, while the distal end of the outlets 3*a* and 3*b* has an inner diameter of 4.3 mm±0.1 mm.

An annular connecting region 6 is provided on the end face 5 to connect the cartridge 2 to an accessory part, which region in this case has an internal thread 6*a* for connecting to the accessory parts.

Figure 2A:
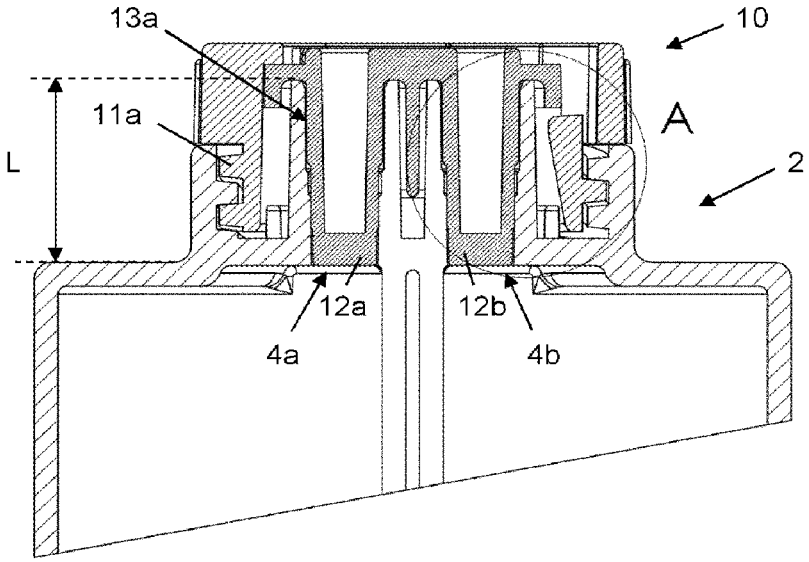
FIG. 2A shows an application system according to the present disclosure, having a cartridge and a first accessory part, in this case a stopper.
Figure 2B:
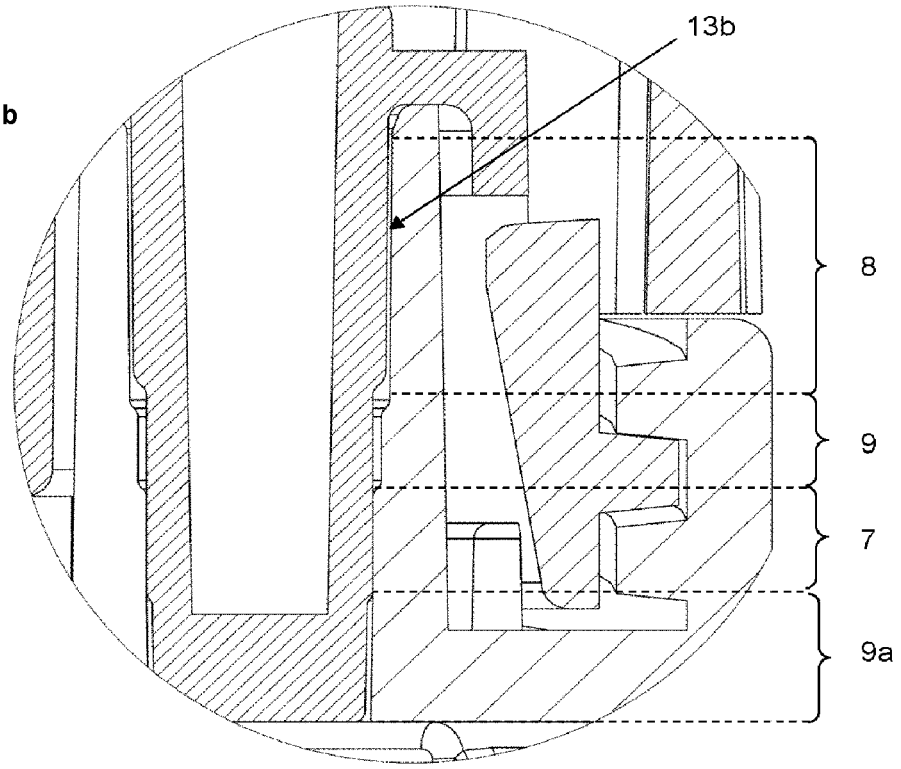
FIG. 2B shows the enlarged detail A from FIG. 2A.

In FIGS. 2*a* and 2*b*, a first accessory part, in this case a stopper 10, is connected to the cartridge 2. The stopper 10 includes a union nut 11 having an external thread 11 *a* which is configured to fit to the internal thread 6 *a* of the connecting region 6 of the cartridge 2. Furthermore, an insert received in the union nut 11 is provided, which insert has two closing pins 12 *a* and 12 *b* which can be inserted into the respective outlets 3 *a* and 3 *b*.

The outer contour of the closing pins 12*a* and 12*b* is adapted to the inner contour of the respective outlets 3*a* and 3*b* such that these achieve a seal between the outlet 3 and the stopper 10 via a first seal plane 7. In the region of the second seal plane 8, the seal of which is explained in detail below in the context of the second accessory part, the outer contour of the closing pins 12*a* and 12*b* of the first accessory part 10 is selected such that an annular gap 13*a*, 13*b* is formed, respectively, between the closing pins 12*a*, 12*b* and the outlets 3*a*, 3*b* along the second seal plane 8.

In other words, an annular gap 13*a* is provided around the closing pin 12*a*, and a second annular gap 13*b* is provided around the second closing pin 12*b*. The annular gaps 13*a*, 13*b* prevent contact between the outlets 3*a* and 3*b* and the closing pins 12*a* and 12*b* in that region that is responsible for forming the second seal plane 8, and they are particularly dimensioned such that even production-related variations during the production of the cartridge 2 or the first accessory part 10 will not result in forming a contact surface in the region of the second seal plane 8.

Furthermore, a seal-free section 9 is formed between the first seal plane 7 and the second seal plane 8. For example, this section extends in the axial direction over 1.91 mm 0.1 mm of the outlets 3*a* and 3*b*.

A second seal-free section 9*a* is formed in a direction opposite the material discharge direction viewed from the first seal plane 7, which section extends to the outlet openings 4*a* and 4*b*. This second seal-free section 9*a* is in a radial plane with the end face 5 of the cartridge 2 on its end situated in the opposite direction of the material discharge direction.

The axial length of the closing pins 12*a* and 12*b* is dimensioned such that these extend to the outlet openings 4*a* and 4*b*, such that no or just a minimal amount of the material stored in the containers 2*a* and 2*b* can enter the outlets 3*a* and 3*b*. For example, the closing pins 12*a* and 12*b* extend over 13.5 mm±1 mm from the upper side situated in the material discharge direction to the lower side of the stopper 10 situated in a direction opposite the material discharge direction, viewed in the axial direction.

It is advantageous in this context that the first seal plane 7 is located upstream of the second seal plane 8 in the material discharge direction, viewed from the end face 5 of the cartridge 2, since the material from the containers 2*a*, 2*b* can at best flow to the first seal plane 7. This prevents contamination of the second seal plane 8 during storage.

The second seal-free section 9*a* allows connecting the stopper 10 to the cartridge 2 and the outlet region 3 using relatively little force, and to remove the stopper from these components. This can be achieved, for example, in that the closing pins 12*a* and 12*b* have an outer diameter of 3.7 mm±0.1 mm, which is 0.3 mm±0.2 mm smaller than the inner diameter of the outlet openings 4*a* and 4*b* and the outlets 3*a* and 3*b* in the region of the second seal-free section 9*a*.

If the second seal-free section 9*a* were omitted and a form-fitting contact surface and thus a seal between the closing pins 12*a* and 12*b* and the respective outlets 3*a* and 3*b* were provided instead of the annular gap formed there, the first seal plane 7 would extend to the outlet openings 4*a* and 4*b*. Then the first seal plane 7 would engage in the relatively inflexible region of the end face 5 of the cartridge 2, which would require more force to insert and remove the closing pins 12*a* and 12*a* without substantially improving the sealing effect. In the preferred embodiment shown here, both the first seal plane 7 and the second seal plane 8 are therefore at a spacing from the end face 5 of the cartridge 2 in the material discharge direction.

Figure 3A:
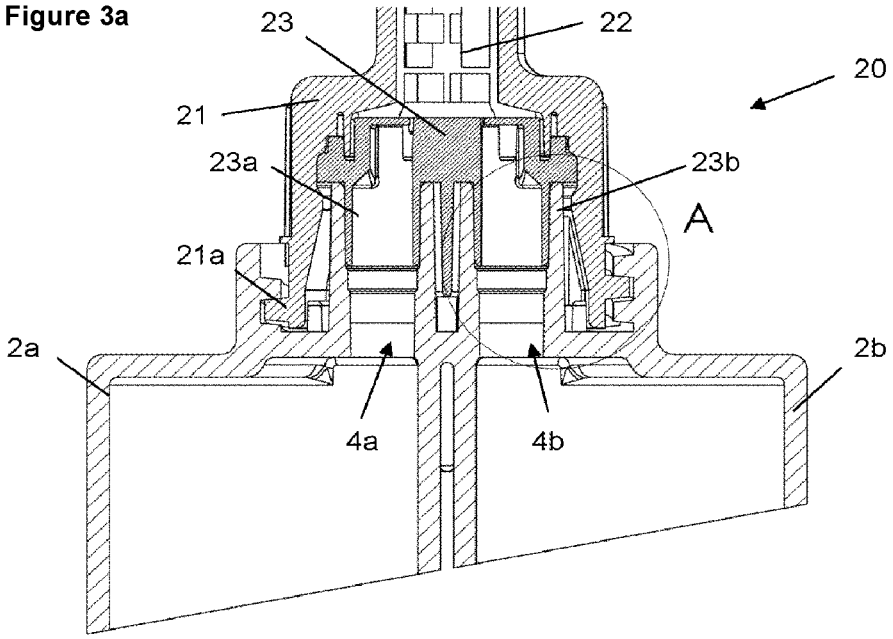
FIG. 3A shows an application system according to the present disclosure, having a cartridge and a second accessory part, in this case a static mixer.
Figure 3B:
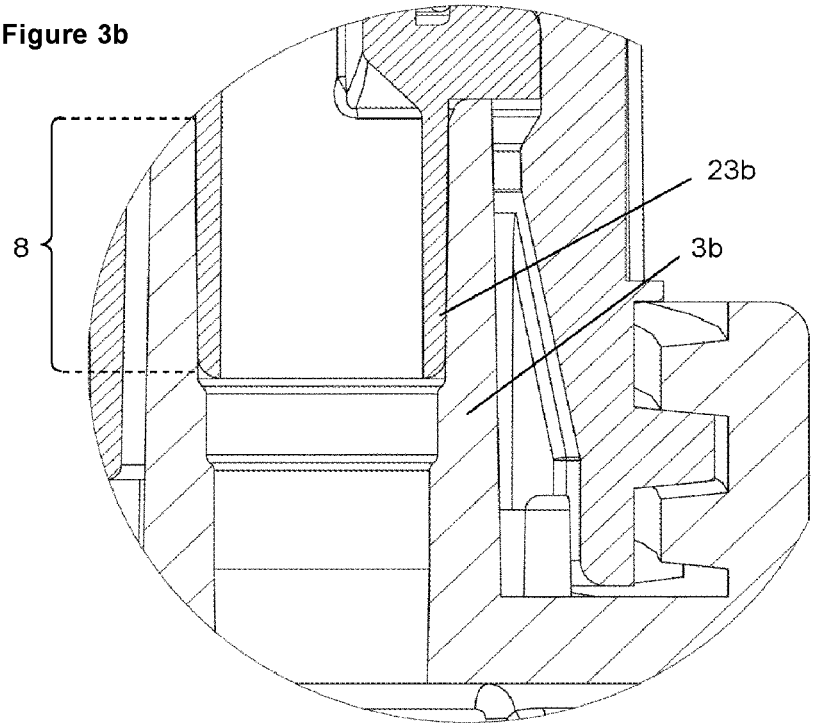
FIG. 3B shows the enlarged detail A from FIG. 3A.
Figure 4A:
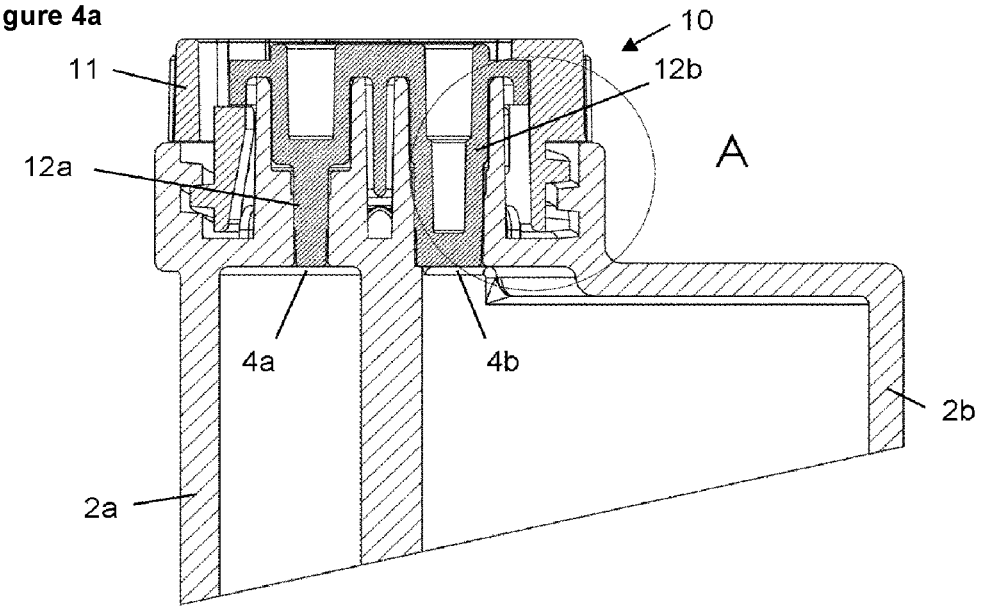
FIG. 4A shows an application system according of the disclosure according to the second embodiment, having a cartridge and a first accessory part, in this case a stopper.
Figure 4B:
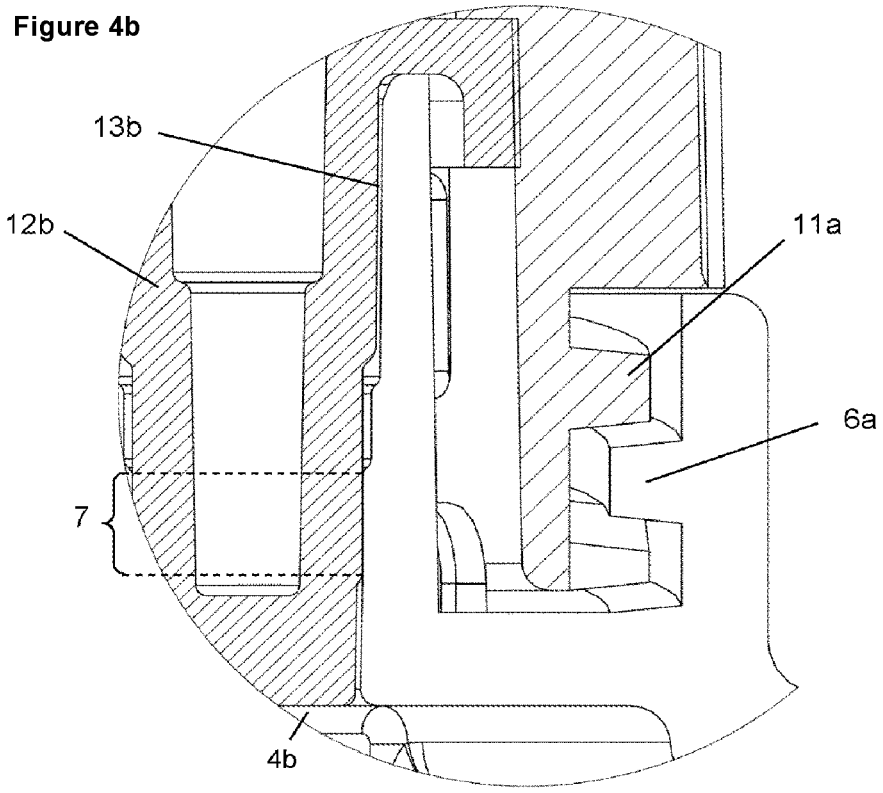
FIG. 4B shows the enlarged detail A from FIG. 4A.
Figure 5A:
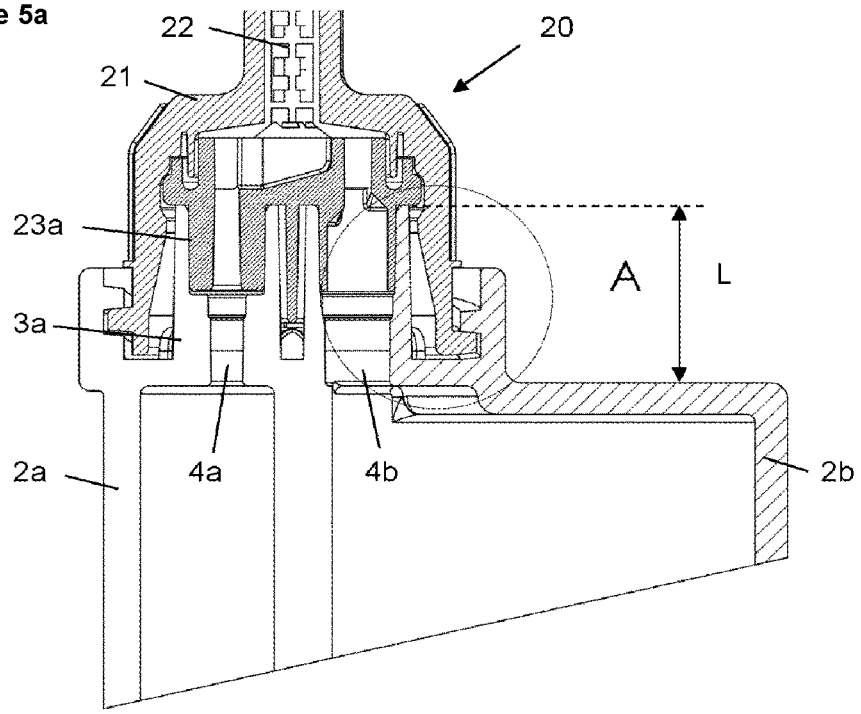
FIG. 5A shows an application system of the disclosure according to a second embodiment, having a second accessory part, in this case a static mixer.
Figure 5B:
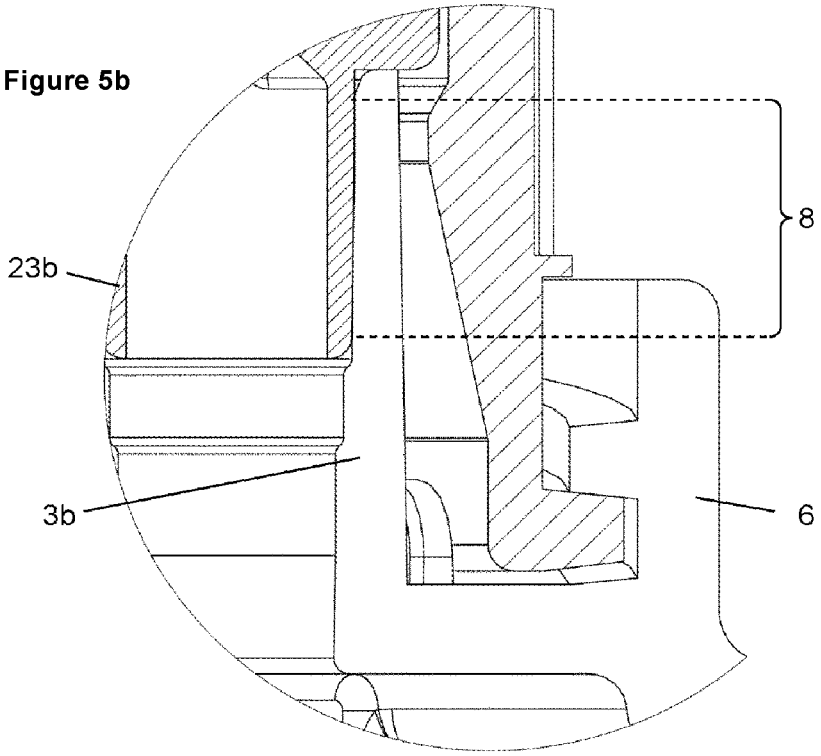
FIG. 5B shows the enlarged detail A from FIG. 5A.

FIGS. 3A and 3B show an application system 1 having a second accessory part, in this case a static mixer 20. The mixer 20 comprises a housing 21 having an external thread 21*a* which is configured to fit to the internal thread 6*a* of the connecting region 6. A mixing region with a static mixing element 22 is provided within the housing 21. According to the present disclosure, dynamic mixers may be used as well. Furthermore, the second accessory part has an inlet region 23, which is also received within the housing 21. The inlet region 23 has inlets 23*a* and 23*b* configured corresponding to the outlets 3*a* and 3*b*, which inlets are in this case configured to be inserted into the outlets 3*a* and 3*b*.

Since the inner contour of the outlets 3*a* and 3*b* on their ends projecting away from the end face 5 in the material discharge direction are configured to fit the outer contours of the inlets 23*a* and 23*b*, a second seal plane 8 is formed in this region. For example, the inner diameter of the outlets 3*a* and 3*b* and the outer diameter of the inlets 23*a* and 23*b* can each be 4.3 mm 0.1 mm.

As is also visible in FIGS. 3A and 3B, the inner contours of the inlets 23*a* and 23*b* are flush with the outlet openings 4*a* and 4*b* of the respective containers 2*a* and 2*b*. For example, the inner diameter of the inlets 23*a* and 23*b* as well as the inner diameter of the outlet openings 4*a* and 4*b* can each be 4 mm±0.1 mm.

The flush alignment of inlets 23*a* and 23*b* with the output openings 4*a* and 4*b* can be achieved in the embodiment shown because the inner contour of the outlets 3*a* and 3*b* in the region of the second seal plane 8 is greater than in the region of the first seal plane 7 and the seal-free sections 9 and 9*a*. Thus the inner diameter of the outlets 3*a* and 3*b* increases in the material discharge direction.

The embodiment of the application system according to the present disclosure shown in FIGS. 1 to 3B is particularly suitable for application cases in which the containers 2*a* and 2*b* are configured to be filled with the same volumes, such that the mixing ratio of the two materials stored in the containers is about 1:1.

The second embodiment, which is shown in FIGS. 4A to 5B, shows a design of the application system 1 according to the present disclosure in which the volumes of the containers 2*a* and 2*b* are different.

In the FIGS. 4A to 5B, the container 2*a* is smaller than the container 2*b*. The size of the respective outlet openings 4*a* and 4*b* is also adapted to the volume ratio of containers 2*a* and 2*b*. The same applies to the outlets 3*a* and 3*b*, the closing pins 12*a* and 13*b*, and the inlets 23*a* and 23*b* of the second accessory part 20. Since the remaining features of the second embodiment match the first embodiment according to FIGS. 1 to 3*b*, we refer to the detailed description above.

The invention claimed is:

1. An application system comprising:

a cartridge;

at least one first accessory part; and at least one second accessory part comprising a mixer, wherein the cartridge has at least one container with an outlet opening and at least one outlet connected to the container via the outlet opening on an end face of the cartridge, wherein the at least one outlet is configured for connection to both the at least one first accessory part and to the at least one second accessory part such that a seal is produced between the at least one outlet and both the at least one first accessory part and the at least one second accessory part, wherein at least one separate seal plane is provided for both the at least one first accessory part and the at least one second accessory part, where the at least one separate seal planes are located on an inner contour of the at least one outlet, and wherein both the at least one first accessory part and the at least one second accessory part is associated with the at least one of the separate seal planes.

2. The application system according to claim 1, wherein a seal between the at least one first accessory part and the at least one outlet is ensured by at least one first seal plane, and in that a seal between the at least one second accessory part and the at least one outlet is ensured by at least one second seal plane.

3. The application system according to claim 2, wherein the at least one second seal plane is disposed downstream of the at least one first seal plane in a material discharge direction.

4. The application system according to claim 2, wherein an annular gap remains between the first accessory part and at least one second seal plane if the first accessory part is connected to the at least one outlet, and/or in that the second seal plane is free form and contact-free with respect to the first accessory part.

5. The application system according to claim 1, wherein a seal-free section is provided between the respective seal planes.

6. The application system according to claim 3, wherein the at least one first seal plane is disposed at a spacing from the end face of the cartridge in the material discharge direction.

7. The application system according to claim 3, wherein the at least one first seal plane, when viewed in the material discharge direction from the end face of the cartridge, is formed in the range of 5% to 50% of the axial length (L) of the at least one outlet, and/or in that the at least one second seal plane, when viewed in the material discharge direction from the end face of the cartridge, is formed in the range of 51% to 100% of the axial length (L) of the at least one outlet.

8. The application system according to claim 1, wherein the first and/or second accessory part is configured to be sealingly insertable into the at least one outlet.

9. The application system according to claim 8, wherein the at least one first seal plane is formed on a first inner contour of the at least one outlet and the at least one second seal plane is formed on a second inner contour of the at least one outlet.

10. The application system according to claim 7, wherein the first and/or the second accessory part comprises an inlet sealingly insertable into the at least one outlet, wherein the inner contour of the inlet is flush with the outlet opening of the container in the material discharge direction.

11. The application system according to claim 1, wherein the at least one outlet is configured to be sealingly insertable into the first and/or second accessory part.

12. An application system comprising:

a cartridge;

a first accessory part; and a second accessory part comprising a mixer, wherein the cartridge comprises two containers, where each container has an outlet comprising an outlet opening on an end face of the cartridge, wherein the outlets are configured for connection to both the first accessory part and to the second accessory part such that a first seal is formed between the outlet and the first accessory part, and a second seal is formed between the outlet and the second accessory part, and wherein the first seal and the second seal are located on an inner contour of the outlet.

13. The application system of claim 12, further comprising a seal-free section located between the first seal and the second seal.

14. The application system of claim 13, wherein the first accessory part or the second accessory part is configured to be sealingly insertable into the outlet to form either the first or second seal.

* * * * *